US005957573A

United States Patent [19]

Wedekind et al.

[11] Patent Number: 5,957,573

[45] Date of Patent: Sep. 28, 1999

[54] RECESSED FIXTURE FRAME AND METHOD

[75] Inventors: Robert James Wedekind, Riverside, R.I.; Mark Owen Jones, South Dartmouth; Graham Michael Rippel, South Easton, both of Mass.; Dennis Joseph Foley, Holland, Mich.; Joseph Anthony Capostagno, Somerset, Mass.

[73] Assignee: Lightolier Division of The Genlyte Group Inc., Fall River, Mass.

[21] Appl. No.: 08/924,349

[22] Filed: Sep. 5, 1997

[51] Int. Cl.[6] ..... F21S 1/06

[52] U.S. Cl. ..... 362/365; 362/364; 362/147; 362/368; 362/371

[58] Field of Search ..... 175/65 R; 362/147, 362/364, 365, 366, 368, 370, 371; 248/286.1

[56] References Cited

U.S. PATENT DOCUMENTS

| | | | |
|---|---|---|---|
| 4,277,641 | 7/1981 | Bauer | 175/65 R |
| 5,678,794 | 10/1997 | Kump | 248/220.31 |
| 5,690,423 | 11/1997 | Hentz | 362/365 |
| 5,758,959 | 6/1998 | Sieczkowski | 362/365 |
| 5,803,585 | 9/1998 | Littman | 362/147 |

*Primary Examiner*—Sandra O'Shea
*Assistant Examiner*—Marshall Honeyman
*Attorney, Agent, or Firm*—Hopgood, Calimafde, Kalil & Judlowe, LLP

[57] ABSTRACT

An improved recessed fixture frame and method for installing the recessed fixture frame in new, existing or rough-in construction is disclosed. The improved recessed fixture frame includes a frame band for supporting and surrounding a fixture housing and at least one mounting assembly connected to the frame band in such a manner that the frame band is capable of being adjusted between the ends of the mounting bars. The mounting assembly includes at least one hinged mounting stub operatively hingeably connected to at least one end of the mounting assembly. Each hinged mounting stub includes a fastening means for affixing the recessed fixture frame to a structural member in a first position. In the first position, the recessed fixture frame extends downwardly from the structural member. After the fixture frame has been wired-in, the fixture frame is rotated about ninety degrees (90°) about the hinged mounting stubs to a second position where the non-hinged mounting stub at the other end of the mounting assemblies are operatively connected to a second structural member.

43 Claims, 12 Drawing Sheets

RECESSED FIXTURE FRAME AND METHOD

RELATED APPLICATIONS

This application is related to U.S. patent application Ser. No. 08/884,006, filed Jun. 27, 1997, the disclosure of which is herein incorporated by reference.

BACKGROUND OF THE INVENTION

The present invention relates in general to recessed fixture frames or other devices installed in the walls and/or ceilings of buildings having support structures and methods of installing recessed fixture frames. More particularly, it relates to simple and reliable recessed fixture frames and methods of installing same in areas having limited, if any, access from above or behind the recessed fixture frames. Even more particularly, it relates to recessed light fixture frames that meet Underwriters Laboratory (UL) standards and building codes.

Various recessed fixture frames and methods, for installing lighting fixtures in new construction, rough-in construction and the like have been developed and practiced by the lighting industry. Examples of prior systems and methods for installing lighting fixtures in existing construction in the field of the present invention include those described in the U.S. patents of the assignee of the present application: U.S. Pat. Nos. 5,457,617; 5,452,816; 5,374,812; 5,317,493; 5,222,800 and 4,646,212, the disclosure of each is herein incorporated by reference. Additionally, U.S. Pat. No. 4,739,460 discusses a spring clip for a recessed light fixture.

The prior art constructions and methods all have disadvantages in that the mechanical aspect must be installed as a single one-position unit forcing the installing electrician to work in the confined space above the ceiling line.

Other problems with some prior fixtures, include the inability: to be installed in constructions made from a variety of materials; to adjust the position of the enclosure to accommodate different ceiling thicknesses or inaccurate placement of the fixture; to allow horizontal or vertical adjustment when positioning the fixture; to provide a housing having an edge that is not dangerously sharp, thus preventing cutting the mechanic or electrician during installation; to provide fixture reflectors and sockets which are tightly secured together within the housing; to accurately and securely position a junction box relative to the trim positioned in the housing; to remove knock-outs from the junction box easily without the use of a separate tool; to prevent an electrical disconnect caused by pulling the cable out of the junction box; to readily release the reflector from connection to the socket; to accurately and securely position a junction box relative to the position of the fixture housing such that the temperature of the junction box was not adversely affected by the operation of the fixture; to be capable of withstanding electrical disconnect caused by up to fifty (50) pounds of pulling force on the wire extending from the junction box and keeping the junction box door open during the electric cable installation.

SUMMARY OF THE INVENTION

Accordingly, it is an object of the present invention to provide a recessed fixture frame that can be installed as a single unit allowing the installer to work comfortably in an open space below the ceiling line.

Another object of the present invention is to provide a single unitary recessed fixture frame that an installer can install in the desired space, wire-in at his or her convenience, and then connect the fixture to the other support structure to complete the installation.

A further object of the present invention is to provide a recessed fixture frame that is capable of being installed in constructions made from a variety of materials.

A still further object of the present invention is to provide a recessed fixture frame that may be horizontally or vertically adjusted after installation to accommodate different ceiling thicknesses or inaccurate placement of the fixture.

Another object of the present invention is to provide a recessed fixture frame having a housing that will avoid cutting the mechanic or electrician during installation.

A still further object of the present invention is to provide a recessed light fixture frame having the reflector readily releasable and secured to the socket.

Yet another object of the present invention is to provide a recessed fixture frame which accurately and securely positions the junction box on a frame band relative to the position of the fixture housing such that the temperature of the junction box is not adversely affected by the operation of the fixture.

Another object of the present invention is to provide a recessed fixture frame that has a junction box with easily removable knockouts for receiving the electrical cable.

Still another object of the present invention is to provide a recessed fixture frame having a junction box that is capable of withstanding electrical disconnect caused by up to fifty (50) pounds of pulling force on the wire extending from the junction box.

Another object of the present invention is to provide a junction box which includes a door which remains open during the electric cable installation.

In accordance with one aspect of the present invention, we have provided a recessed fixture frame for connecting a recessed fixture frame to a structure, the recessed fixture frame comprising: a frame band; at least one mounting assembly operatively connected to the frame band, the mounting assembly including means for selectively increasing or decreasing its length; and means, operatively hingeably connected to at least one end of the at least one mounting assembly, for operatively connecting the mounting assembly to a structural member.

In accordance with another aspect of the present invention, we have provided a recessed fixture frame comprising: a frame band; at least one mounting assembly operatively connected to the frame band, the mounting assembly including a channel member and a bar member, the bar member being movable relative to the channel member for selectively increasing or decreasing the length of the mounting assembly; and at least one mounting stub, operatively hingeably connected to at least one end of the mounting assembly, the mounting stub having a hook for cooperating with a complementary member formed in the bar member, for locking the mounting stub and the bar member such that the bar member is prevented from moving relative to the channel member.

In accordance with still another aspect of the present invention, we have provided a recessed fixture frame comprising: a frame band; at least one mounting assembly operatively connected to the frame band, the mounting assembly including means for selectively increasing or decreasing its length; at least one mounting stub operatively hingeably connected to at least one end of the at least one mounting assembly; an enclosure for housing an electric fixture, the enclosure having means for vertically adjusting the enclosure relative to the frame band, the enclosure having an open end and a closed end, the open end having a hemmed edge, the closed end having a self adjusting spring means for securing a socket and a trim therein and including means for receiving at least one electric cable; a junction box, operatively connected to the frame band at a predetermined distance from the enclosure such that junction box temperature remains within an acceptable range, the junction box including at least five side walls, a top wall and a bottom wall, at least one of the side walls having an opening for receiving at least one electric cable, the junction box including means for securing the top wall and bottom wall of the junction box to the side walls; and clamping means, operably positioned in at least one of the side walls of the junction box, for restricting movement of the electric cable, the clamping means including at least one aperture having about the same cross-sectional size as a cross section of the electrical cable, the clamping means being positioned such that the cable freely moves within the clamping means aperture as the cable is inserted into the aperture, when the direction of movement of the cable is reversed the clamping means aperture engages the cable such that removal of the cable from the junction box is effectively prevented.

In accordance with yet another aspect of the present invention, we have provided a junction box for use with a recessed fixture frame, the junction box comprising: at least five side walls, at least one of the five walls having at least one knock-out formed therein; a door; a rear wall; and at least one clamping mechanism, operatively connected to at least one side wall and operatively positioned proximate the at least one knock-out, the clamping mechanism being effective to prevent an electric cable from being pulled out of the junction box for a force of up to about fifty (50) pounds exerted on the electric cable.

In accordance with yet another aspect of the present invention, we have provided a device for connecting a recessed fixture frame to a structure, the device comprising: a mounting assembly, the mounting assembly including means for selectively increasing or decreasing its length; a fastening member comprising: a first portion and a second portion, the first portion being connected to the second portion at about a ninety degree (90°) angle; and the fastener member being operatively hingeably connected to the mounting assembly, the fastener member further including a locking means for locking the second portion to the mounting assembly in a first position, the first position being at about ninety degrees (90°) relative the mounting assembly, the second portion disengaging from the mounting assembly when the mounting assembly is rotated about forty five degrees (45°) from the first position; and means, operatively positioned in the first portion, for connecting the device to a support structure.

In accordance with still another aspect of the present invention, we have provided a quick connect/release mechanism for connecting/releasing trim to/from a light socket, the mechanism comprising: a light socket housing; a light socket operatively positioned inside the socket housing; a trim having at least two notches formed therein; and a trim retaining means, operatively connected to the socket and operatively positioned inside of the socket housing, for mating with the at least two notches formed in the trim such that the trim is effectively retained in position relative to the socket housing and the trim is readily removed from operative connection to the socket.

In accordance with yet another aspect of the present invention, we have provided a clamping mechanism comprising: a body having a "Z" like profile, the body including two tab members, each tab member having an aperture formed therein for receiving an electrical cable and a connecting member for connecting the two tab members; and a pair of protrusions, extending inwardly from an inner edge of each tab member toward the other tab member, for connecting the body to a complementary aperture in the wall of a junction box.

In accordance with yet another aspect of the present invention, we have provided a telescoping mounting assembly comprising: a channel member; a bar member, the channel member and the bar member cooperating to selectively lengthen or shorten the mounting assembly; and a hinged mounting stub, hingeably connected to at least one end of the channel member.

In accordance with another aspect of the present invention, we have provided a method of installing a recessed fixture frame having a junction box between two structural members, the junction box including a door and a clamping mechanism, the method comprising the steps of: positioning a recessed fixture frame having two mounting assemblies and a hinged mounting stub operatively connected to at least one end of each assembly relative the two structural members; lining up the bottom edge of the hinged mounting stubs with the bottom of the first structural member; connecting the first mounting stub to the first structural member; connecting the second mounting stub to the second structural member; opening the junction box, the junction box including knock-outs; opening the appropriate number of knock-outs; inserting non-metallic cable through an aperture resulting from the opening of each knock-out; inserting the cable through an aperture formed in each clamping mechanism corresponding to the particular aperture formed by opening each knock-out; connecting the cable inside the junction box; closing the junction box door; rotating the recessed fixture frame upwardly about ninety degrees (90°) such that the opposite ends of the mounting assemblies having non-hinged mounting stubs are operatively positioned relative to the second structural member; and connecting the non-hinged mounting stubs to the second structural member.

In accordance with still another aspect of the present invention, we have provided a method of removing the lighting trim and the associated socket from a recessed light fixture, the method comprising the steps of: grasping the reflector spring by the ends thereof from inside the trim; squeezing the spring ends toward each other until the trim disengages from the reflector spring; and removing the trim from the lighting housing.

Other objectives and advantages of the present application will become apparent from the following description, the accompanying drawings and the appended claims.

DETAILED DESCRIPTION OF THE INVENTION

Figure 1:
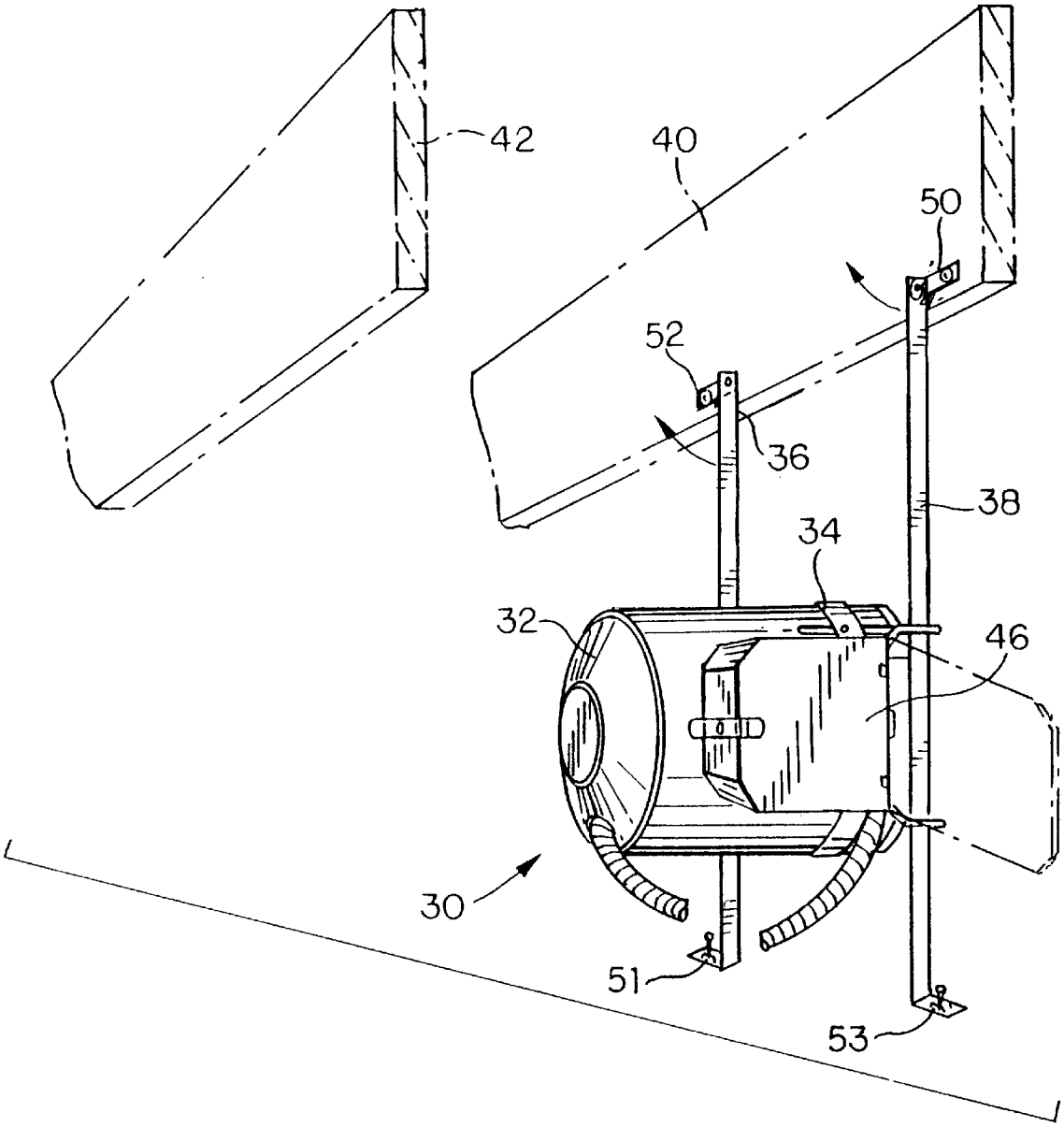
FIG. 1 is a perspective view illustrating a recessed fixture frame of the present invention in an initial installation position.

In carrying out the present invention in preferred forms thereof, we have provided improved recessed fixture frames and methods, for installing the recessed fixture frames in new, existing or rough-in construction in a manner that significantly reduces installation time and facilitates flexible contractor scheduling in that the mechanical and the electrical portions of the installation can be readily accomplished at different times by different personnel. The recessed fixture frames and methods of the present invention are simple, versatile, flexible, low maintenance, cost effective, require no specialized tools, and are space efficient. The recessed fixture frames and methods of the present invention include unique combinations of elements and steps that facilitate the installation of a recessed fixture frames, such as, for example, a light fixture, in new or rough-in construction using a hinged mounting stub having fastening means operatively positioned therein.

FIGS. 1–3 and 7–10 illustrate a representative new recessed fixture frame and new methods of installing the recessed fixture frame. As shown, the recessed fixture frame 30 includes a fixture housing or enclosure 32; a frame band 34 for surrounding and supporting the fixture housing 32; at least two adjustable mounting assemblies 36, 38, operatively connected to the frame band 34 such that the recessed fixture frame band 34 may slide along the mounting assemblies 36, 38 to be horizontally positioned according to the installer's requirements, for positioning the enclosure between two structural members, such as, joists 40, 42; a junction box 46 optionally, operatively connected to the frame band 34 and operatively positioned relative to the fixture housing and hinged mounting stubs 50, 52, operatively hingeably connected to at least one end of each of the mounting assemblies 36, 38 for affixing the recessed fixture frame 30 in position between the joists 40, 42. Each of the above elements of the unique combination of the present invention will be discussed in detail below.

Figure 3:
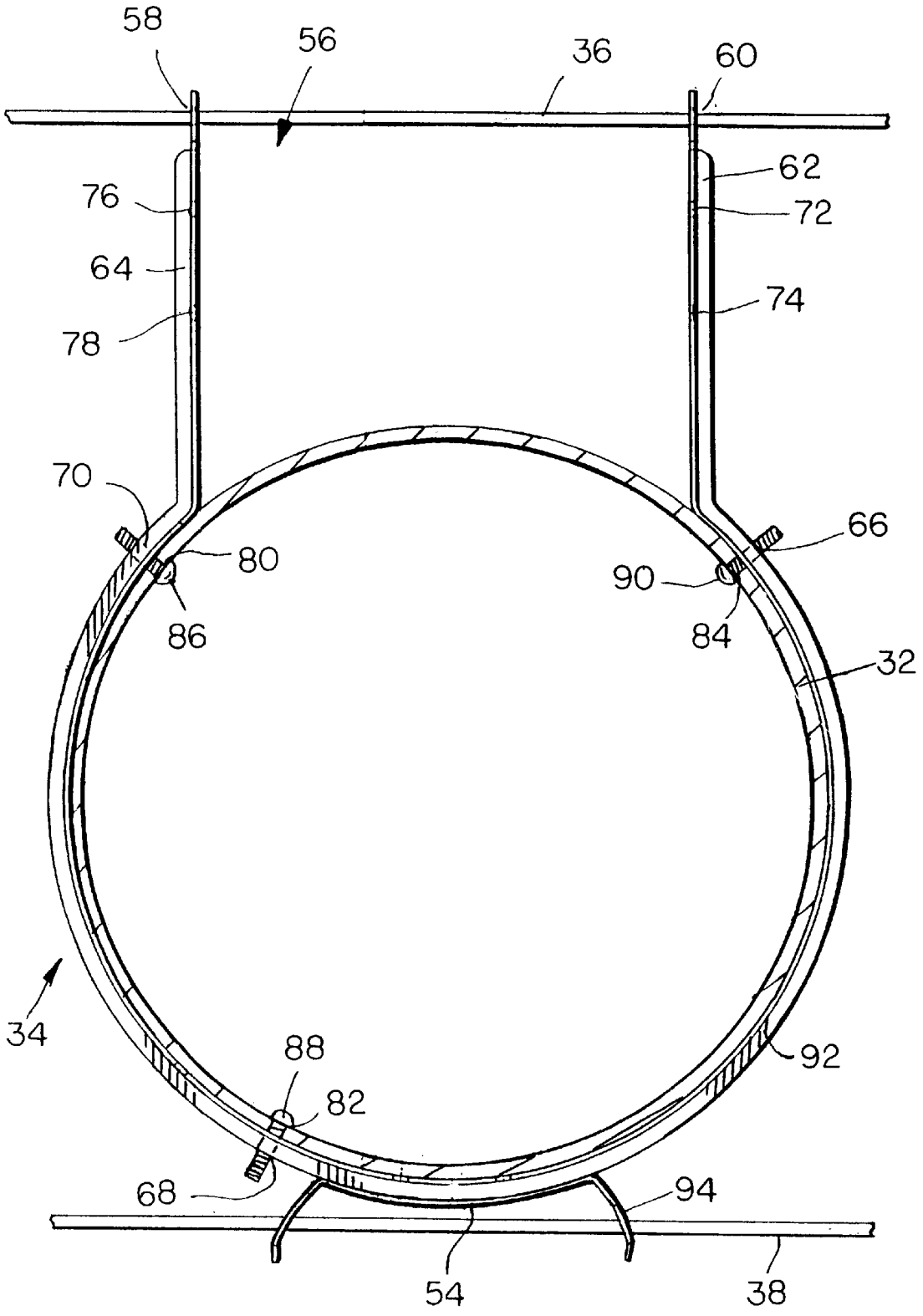
FIG. 3 is an enlarged, top view in partial section illustrating the frame band of the recessed fixture frame of the present invention.

As best illustrated in FIG. 3, the frame band 34 of the present invention, presently preferably, comprises a single piece of stamped material closed at one end 54 and open at the other end 56. The closed end 54 is shaped to conform to a fixture housing, such housing includes, but is not limited to, an enclosure for a lighting fixture, a ventilation system, a smoke detector, a security system or the like. The frame band 34 incorporates means, preferably apertures 58, 60 formed in the legs 62, 64 of the frame band, for connecting each of the legs 62, 64 to one of the mounting assemblies 36. Apertures 66, 68, 70 are provided in the frame band 34, for connecting the frame band 34 to the fixture housing 32. The apertures 66, 68, 70 cooperate with slots found in the housing such that the fixture housing can be adjusted vertically. Additionally, apertures 72, 74, 76, 78 or the like for operatively connecting the junction box 46 between the two legs 62, 64 are operatively positioned in each of the two legs.

The frame band 34 has an integral flange 92 about its circumference from near the end of first leg 62 all the way around the enclosed end 54 to near the end of the second leg 64. The frame band 34 of the present application does not necessarily require multiple fasteners for proper adjustment. It is possible to adjust and secure the enclosure 32 in a vertical position with a single fastener operatively positioned between the two legs 62, 64 of the frame band 34.

A retaining clip 94 for receiving another mounting assembly is operatively connected to the closed end 54 of the frame band 34. The mounting assemblies cooperate for selectively adjusting the position of the housing 32 and the junction box 46 connected to the frame band 34 between the ends of the mounting assemblies 36, 38.

The frame band 34 is, presently preferably, made of about 0.048 inch thick galvanized steel. Other materials that could be used for the frame band 34 include, but are not limited to, aluminum, steel, fiberglass, laminates, composites or other material having sufficient strength and ability to support an electrical or other fixture in position between two structural members.

When used in a lighting application, an enclosure 32, as shown in FIG. 3, is connected to the frame band 34 via slots 80, 82, 84 formed in the enclosure 32. The slots 80, 82, 84 formed in the enclosure 32 correspond to apertures formed in the frame band 34 through which fasteners 86, 88, 90, such as, screws, are connected between the apertures and the slots. The fasteners are used to vertically adjust the enclosure as desired by the installer.

Figure 4:
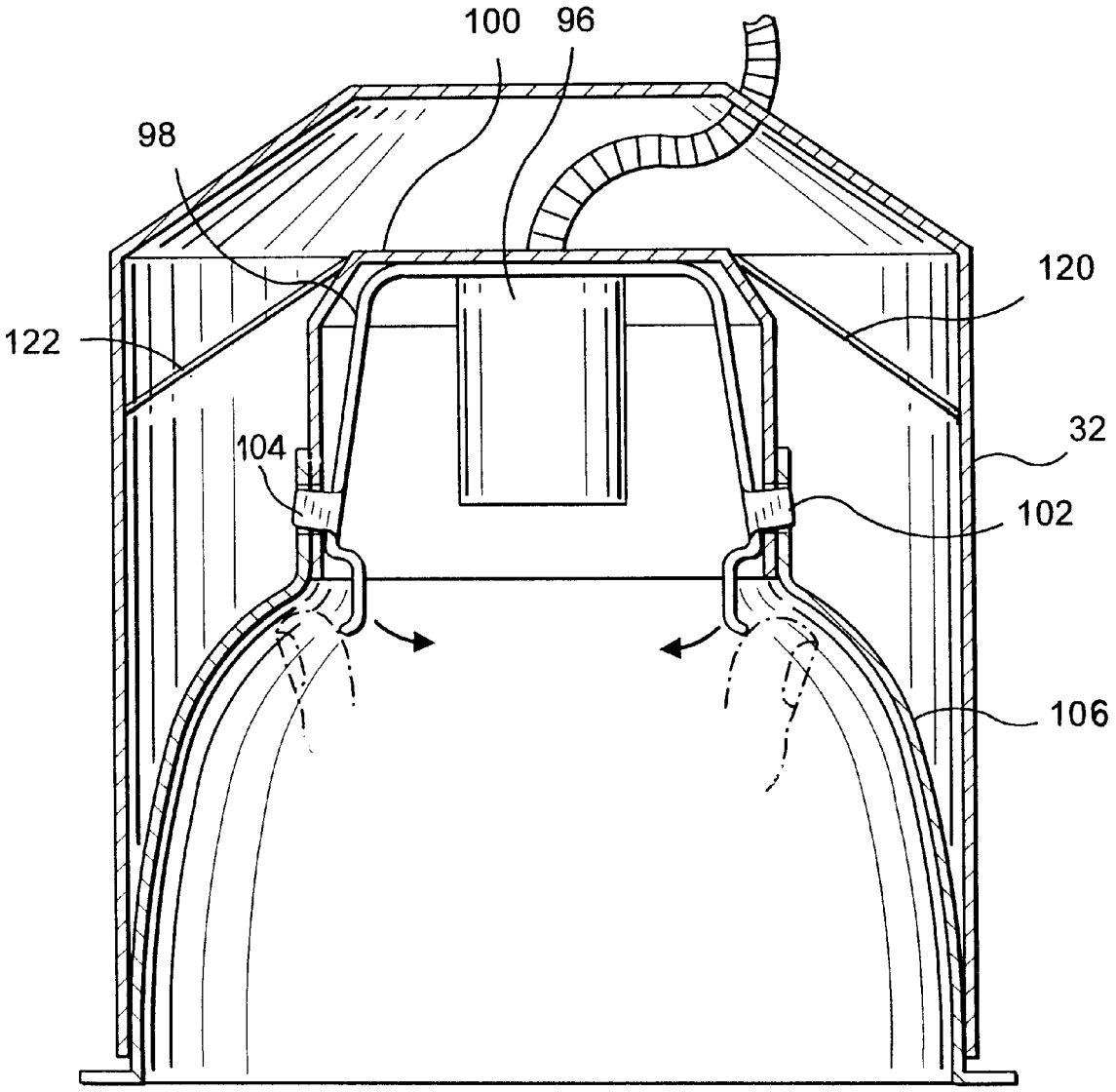
FIG. 4 is a cross-sectional view illustrating a representative enclosure useful in lighting applications with the recessed fixture frame of the present invention.
Figure 5B:
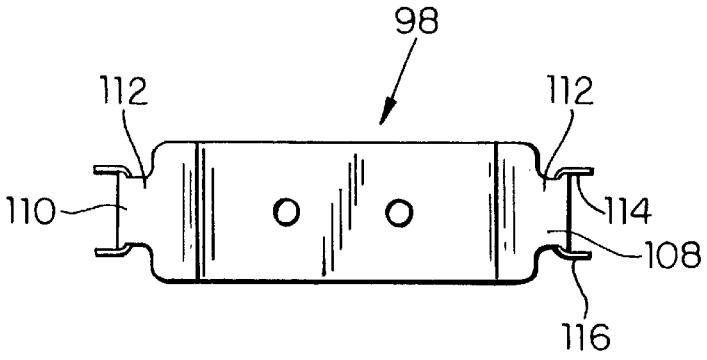
FIG. 5*b* is a top view of the trim retaining means of FIG. 5*a;*
Figure 5A:
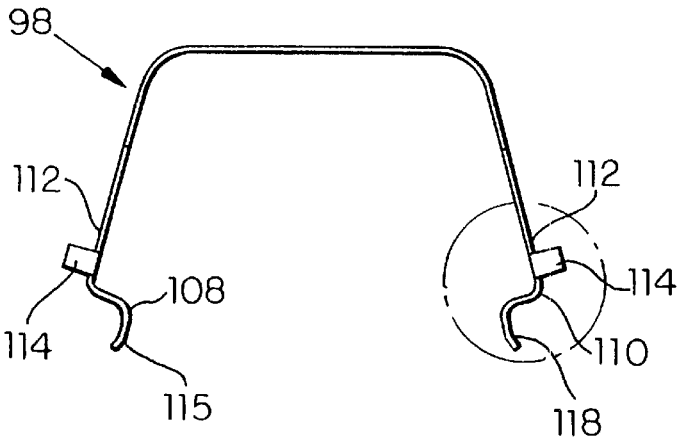
FIG. 5*a* is a side view of a trim retaining means.
Figure 5C:
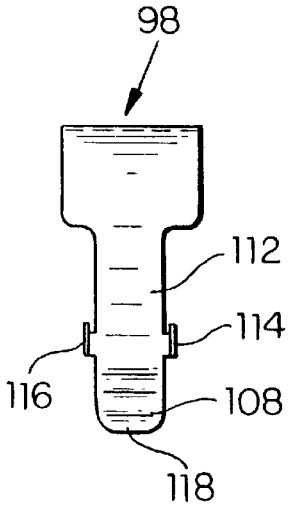
FIG. 5*c* is a side view of trim retaining means of FIG. 5*a;*
Figure 5D:
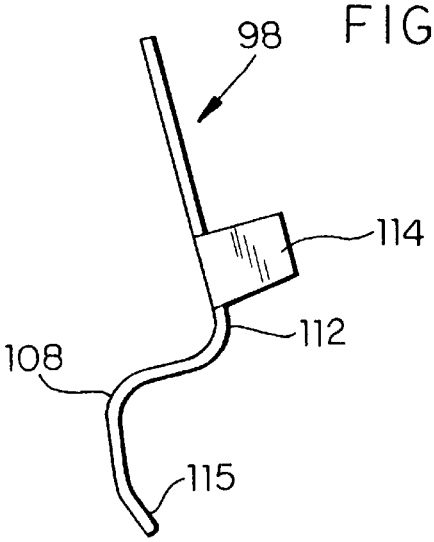
FIG. 5*d* is an enlarged view of an inwardly recessed end of the trim retaining means of FIG. 5*a;*

In FIG. 4, when used as a lighting fixture, a light socket 96 is provided and is conventionally electrically connected to the junction box 46. The socket 96 is conventional except for a unique trim retaining means or spring 98 which is positioned inside of the socket housing 100 and mates with at least two notches 102, 104 formed in the trim 106.

As illustrated in FIGS. 5*a–d,* each end 108, 110 of the trim retaining spring 98 is essentially inwardly offset and has a pair of protrusions 114, 116 for cooperating with notches 102, 104 formed in a lighting fixture trim 106 for retaining the trim 106 inside the housing 32 in proper position relative to the socket 96. The inwardly offset ends 108, 110 are conveniently situated for enabling an installer to apply pressure inwardly away from the outer surfaces of the socket housing 100 to position the trim 106 about the socket housing 100. Once the trim 106 is positioned about the socket housing 100, the trim 106 is adjusted so that the protrusions 114, 116 engage the notches 102 104 in the trim 106 to effectively retain the trim 106 in position relative to the socket housing 100.

This unique trim spring 98 enables the rapid installation or the removal of the trim 106 from the socket housing 100 by merely pressing in on the inwardly offset ends 108, 110 and moving them inwardly toward the socket 96. After the removal of the bulb from the socket, the trim 106 falls by weight of gravity into the hands of the installer. If it is necessary to remove the socket from the housing 32, an installer grasps one of the socket retaining spring ends 120, 122.

The enclosure 32 is hemmed or rolled to the inside diameter which provides a surface which is safe for manually adjusting the enclosure vertically. The vertical adjustment slots 80, 82, 84 in the enclosure 32 could be notched for positioning with or without fasteners.

Figure 2:
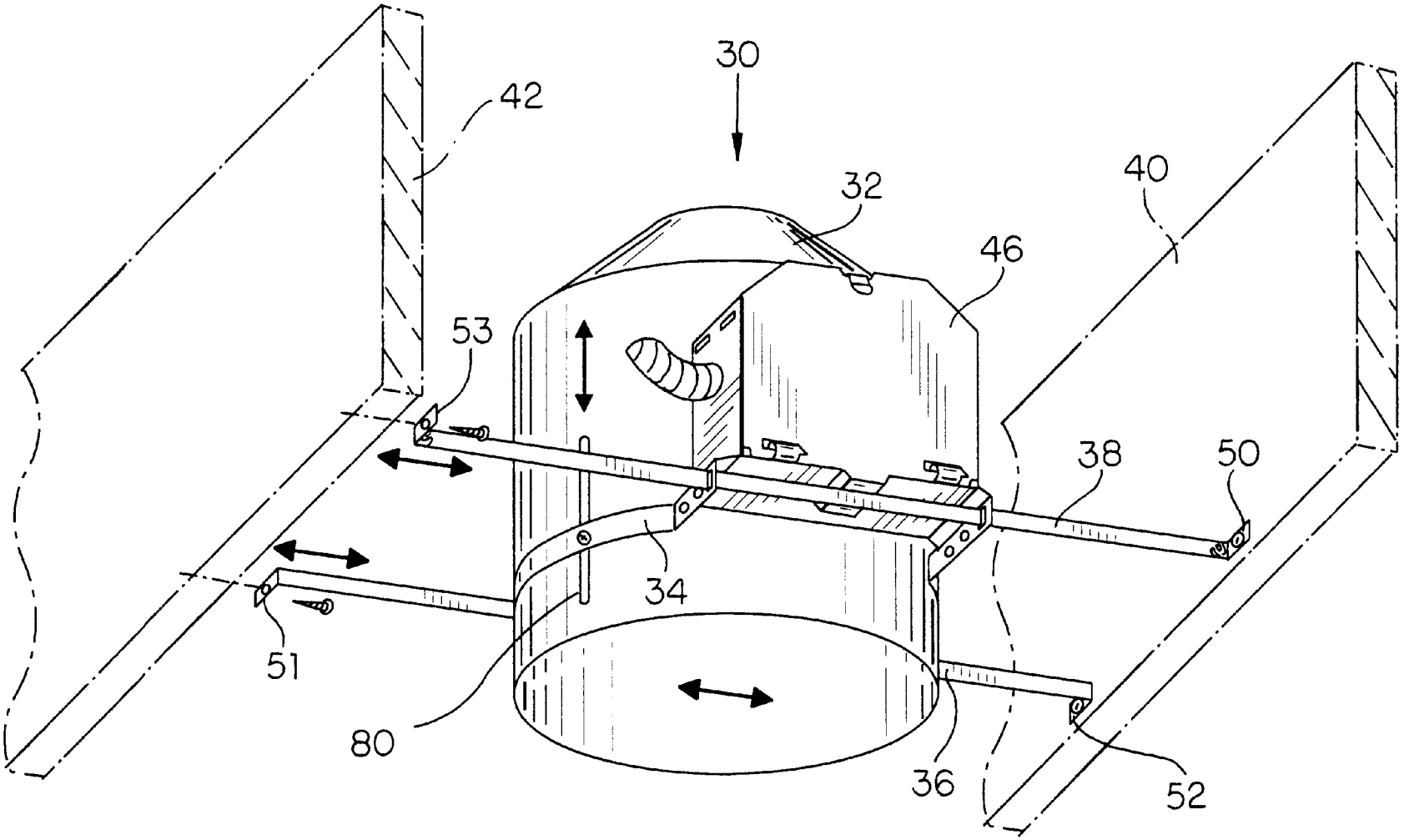
FIG. 2 is a perspective view illustrating the recessed fixture frame of the present invention after installation between two structural members.
Figure 7:
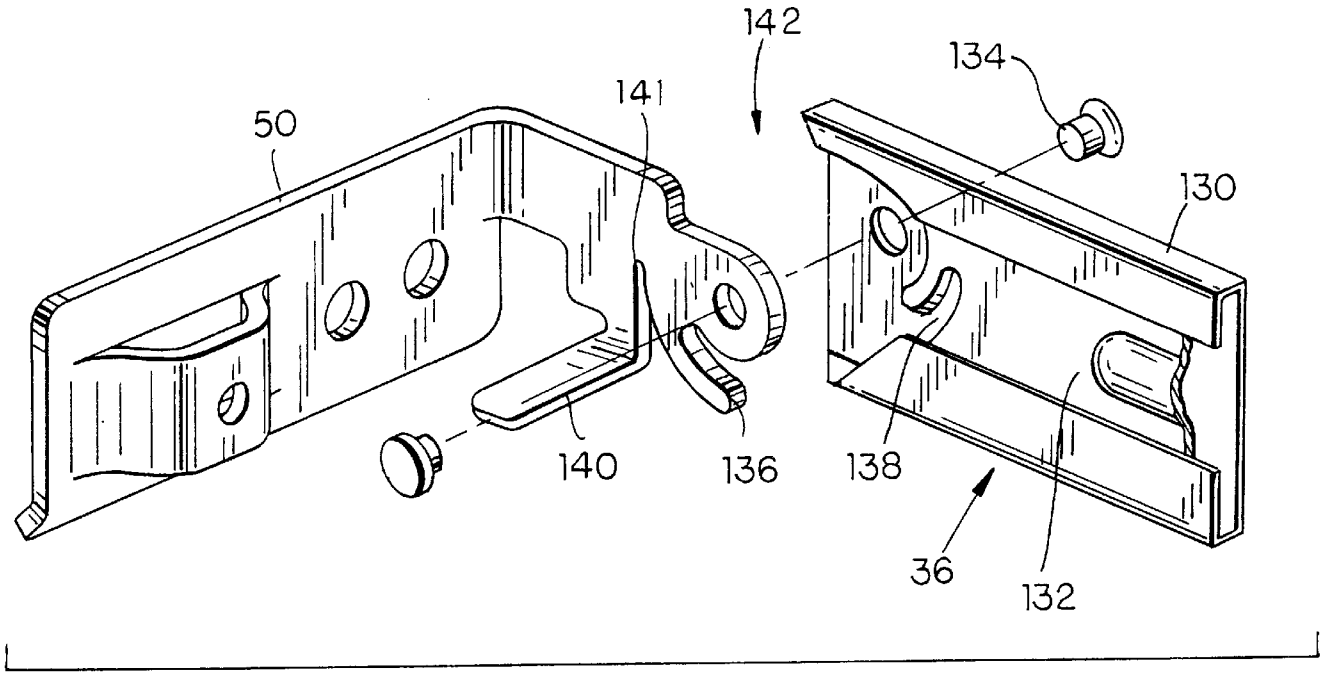
FIG. 7 is an exploded, perspective view of the mounting stub/mounting assembly interface of the present invention.
Figure 6:
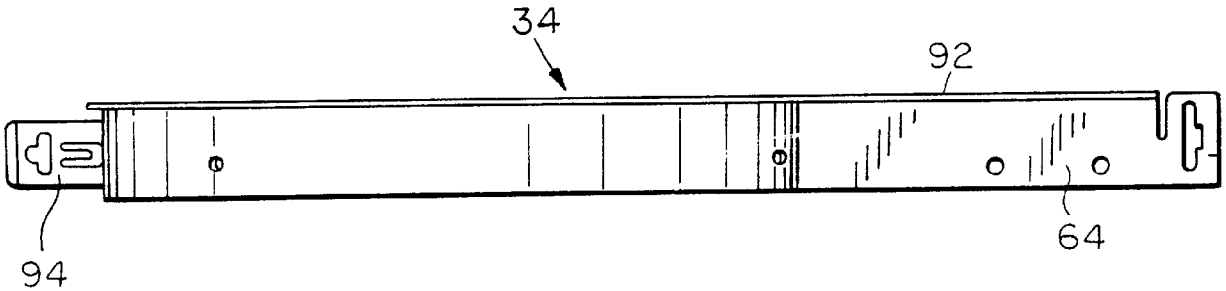
FIG. 6 is a side view of a frame band useful with the present invention.

As shown in FIG. 7, each mounting assembly 36, 38 includes a channel member 130 and a bar member 132. The channel member 130 and the bar member 132 together constitute a telescoping means for selectively lengthening or shortening the mounting assemblies 36, 38 to fit within the space of the "rough-in" or the space between structural members 40, 42, as shown in FIG. 2.

The hinged mounting stub 50 is fastened to the joist or other structural member. The hinged mounting stub 50 is hingeably connected to at least one end of each channel member 130 of each mounting assembly by a fastener 134, such as, for example, a screw, a rivet or the like. The hinged mounting stub includes a mating member 136, such as, for example, a hook or a claw like member, for interacting or mating with a complementary portion 138 operatively positioned in the bar member 132. The hook 136 and the complementary portion 138 together comprise a locking mechanism.

The channel member 130 includes a series of holes or apertures formed along its length for providing for installation in spaces more narrow than the minimum width of the mounting assemblies. Specifically, the bar member can be disconnected from the channel member, the channel member bent at an appropriate location and the channel member secured to the structural member utilizing the apertures.

When the bar member 132 having the complementary portion 138 therein is positioned such that the hook 136 of the mounting stub is engaged therewith (see FIG. 8), the bar member 132 is locked in place such that the bar member 132 is prevented from sliding or moving in the channel member 130 and the relative position of the mounting stub to the mounting assembly is about perpendicular therewith, i.e. about ninety (90°) degrees.

Figure 8:
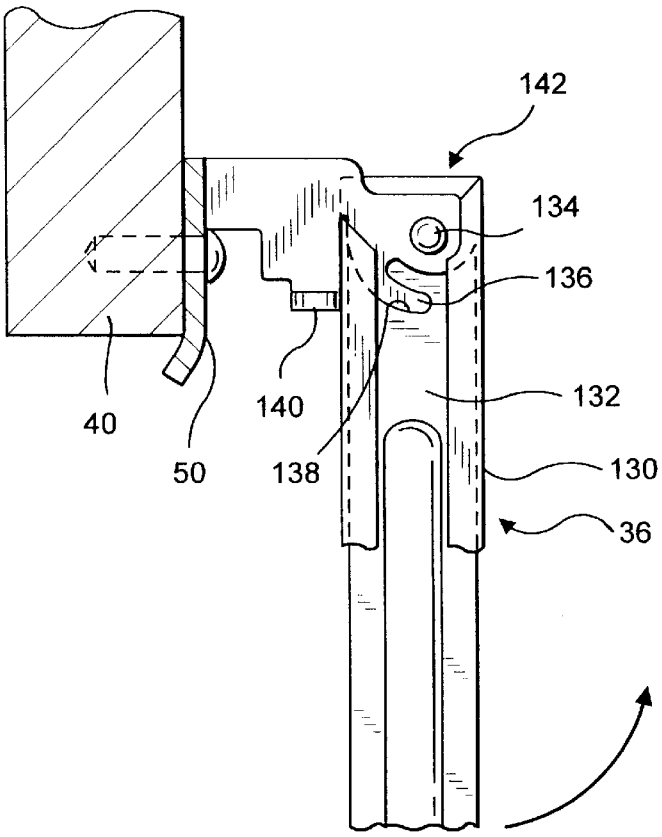
FIG. 8 is an enlarged side view illustrating the mounting stub/mounting assembly initial connection to a structural member.
Figure 9:
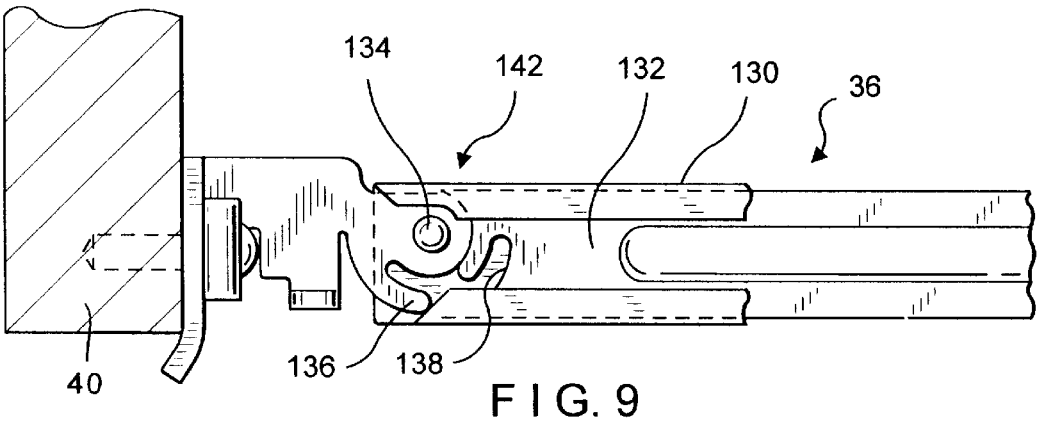
FIG. 9 is an enlarged side view of the mounting stub/mounting assembly interface of FIG. 8 illustrating the disengagement of the mounting assembly locking mechanism after rotation of the mounting assembly from the position of FIG. 8.
Figure 10:
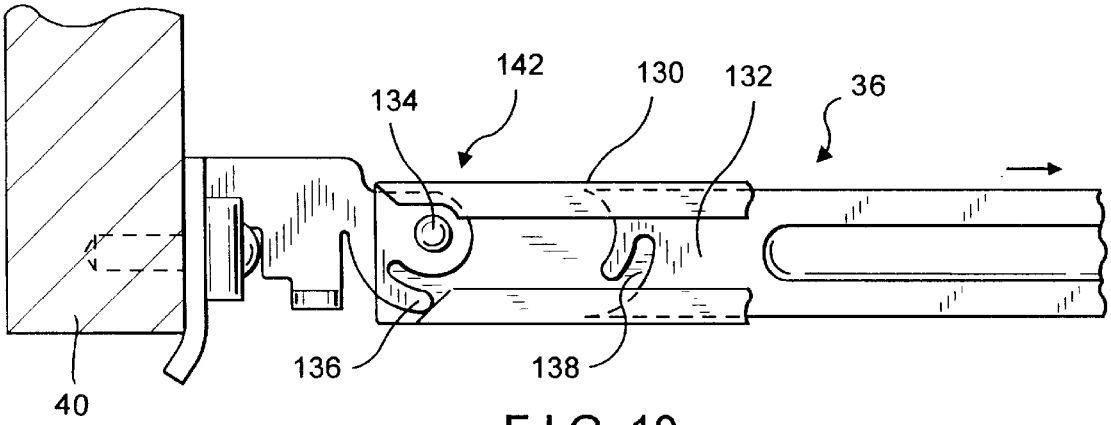
FIG. 10 is an enlarged side view of the mounting stub/mounting assembly interface of FIG. 8 illustrating the telescoping feature of the mounting assembly.

As best shown in FIGS. 1 and 8, with the mounting stub 50 connected to a wood joist 40, the entire recessed fixture frame 30 hangs approximately vertical below the joist. The significance of the locking mechanism 136, 138 lies in the ability of the entire recessed fixture frame 30 to be suspended below one structural member or joist without the telescoping bar member 132 unrestrainably sliding in the channel member 130. The result of such unrestrained movement would be the entire frame 30, less the mounting stub 50 and the channel member 130, crashing to the floor. The locking mechanism also allows additional weight from other items, such as, for example, a ballast or a transformer, electrical items for driving low voltage, or fluorescent light sources, to be supported as optional, integral components of the recessed fixture frame 30.

When the mounting assembly 36 is rotated to the horizontal position for connection of the other end of the mounting assembly to the opposing structural member via, preferably, non-hinged extensions 51, 53, the locking mechanism 136, 138 disengages, thus allowing the bar member 132 to move relative to the channel member 130. As the hinged mounting stub is rotated from the approximately ninety degree (90°) vertical position with respect to the hinged mounting stub toward the horizontal position, at about the forty five degree (45°) position, the hook 136 of the mounting stub disengages from the complementary portion 138 of the bar member 132 thereby providing for the extension of the length of that mounting assembly for connection to the other structural member, typically a distance of about sixteen (16") inches to about twenty four (24") inches center to center.

The hinged mounting stub 50 further includes means, such as for example, a gap 141 operatively formed in the mounting assembly 36, for preventing the rotation of the mounting assembly beyond about ninety degrees (90°) with respect to the mounting stub 50. This feature allows an installer initially to connect one end of two mounting assemblies to the rough-in, let the fixture hang down at about a ninety degrees (90°) angle (see FIG. 8) and install the electric cable as desired.

A finger 140 functions as a t-bar interface in a suspended ceiling application. In a suspended ceiling application having t-bars (not shown), if the mounting assemblies are opened up to a full twenty-four (24) inch center to center, the finger 140 which is connected perpendicular to the mounting assemblies, includes a rectangular portion that interfaces with the t-bar to hold the recessed fixture frame 30 of the present invention in position.

The mounting assemblies, with the hook 136 of the hinged mounting stub engaged with the complementary member 138 of the bar member 132, are shipped from the factory in the approximately ninety degree (90°) pivoted position, because the pivoted position is how the recessed fixture frame 30 should be oriented for connection to the first structural member or joist 40.

As shown in FIG. 1, an important advantage of the hinged mounting stubs 50, 52 and the resulting position during installation is the creation of free space around the fixture which provides the installer with freedom of movement and full maneuverability, as compared to known mounting means. Known mounting means are not hinged and they attach to structural members so as to restrict the working space of the installer.

With the recessed fixture frame 30 of the present invention suspended below the ceiling, installers are able to wire-in the fixture while the fixture frame is suspended below the ceiling line. The hinged mounting stub/mounting assembly interface provides greater access to the junction box 46 in that an installer is not required to position his or her hands between joists 40, 42.

As shown in FIG. 1, the recessed fixture frame 30 of the present invention may also include the unique junction box 46, operatively connected to the frame band between one of the mounting assemblies 38 and the housing 32. The frame band 34 maintains the junction box 46 at a predetermined distance from the housing 32 such that the junction box temperature remains at ninety (90) degrees C. or below.

Figure 11:
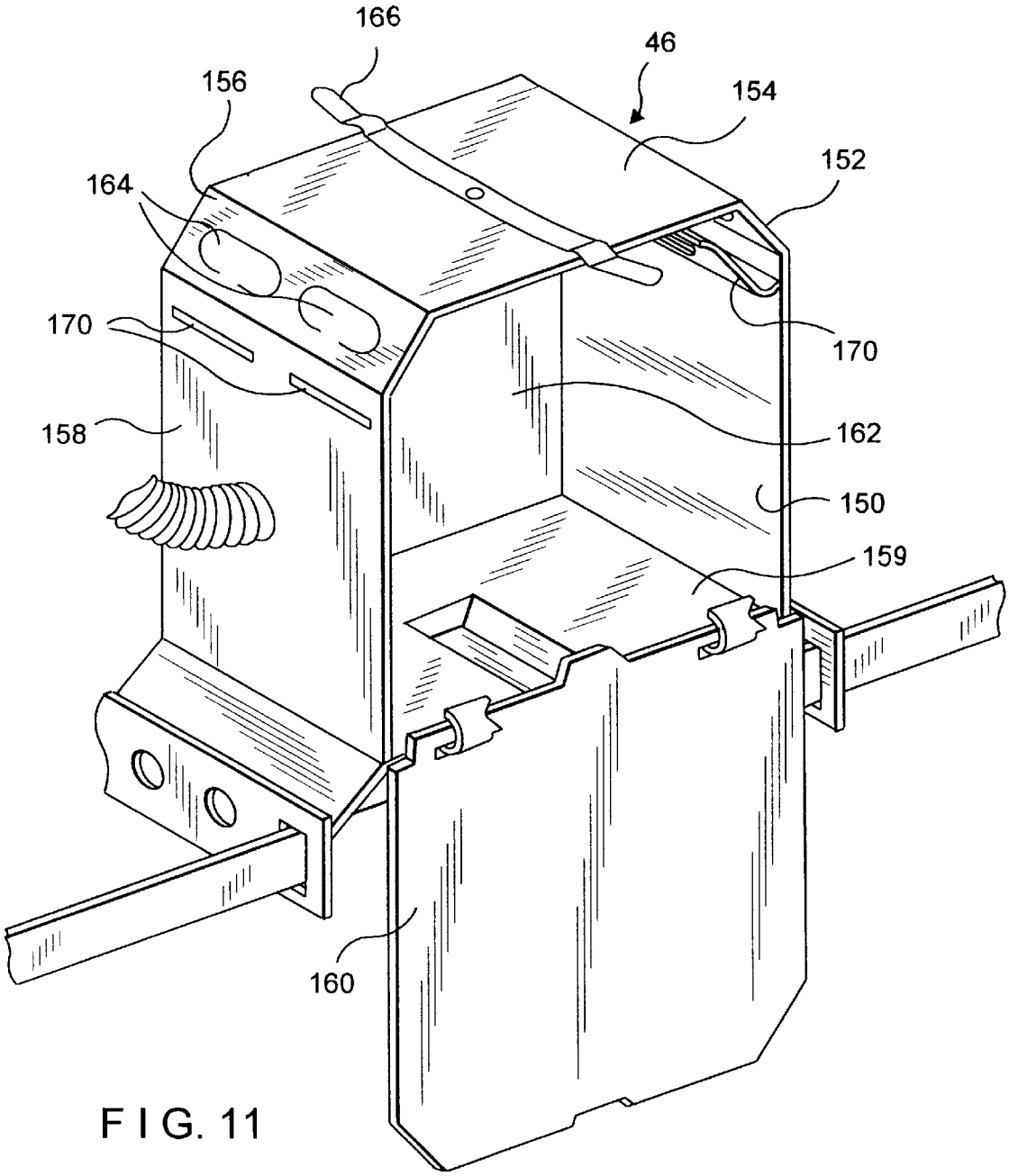
FIG. 11 is an enlarged perspective view of a unique junction box useful with the present invention.

As illustrated in FIG. 11, the junction box 46, presently preferably, includes six side walls 150, 152, 154, 156, 158, 159, a front wall or door 160 and a back wall 162. At least one of the side walls 152 or 156 includes an opening or knock-out 164 where an electric cable, including, but not limited to, Romex, BX or other appropriate factory assembled flexible wire, is intended to be inserted from the exterior of the junction box to the interior thereof for providing proper electrical connections, as is known in the art. The junction box 46 further includes a means 166 for securing the front 160 and back 162 of the junction box, such as for example, a spring attachment, a lock or a clip.

Figure 12:
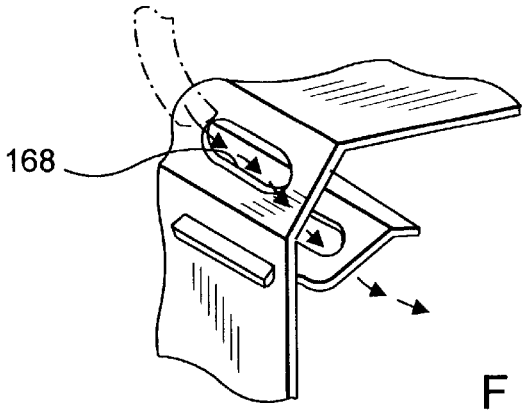
FIG. 12 is an enlarged perspective view of a knock-out positioned in the junction box of FIG. 11.

The two side walls 152, 156 are positioned at about a forty five degree (45°) angle with the contiguous walls 150, 154, 158. These two side walls 152, 156 include at least one and, presently preferably, four (4) knock-outs for providing easy cable access to the junction box upon opening of the knock-outs. The shape of the aperture 168 (see FIG. 12) formed by opening the knock-outs 164 is designed to accommodate the wire type used to wire the typical junction box for the presently preferred lighting fixture applications, but could be designed to accommodate any desirable wire shape, as is known in the art. As shown in FIG. 12, the aperture 168 guides the cable to the clamping mechanism operatively positioned inside the junction box. The knock-outs 164 are easily opened by hand and no tools are required to open them.

Figure 13:
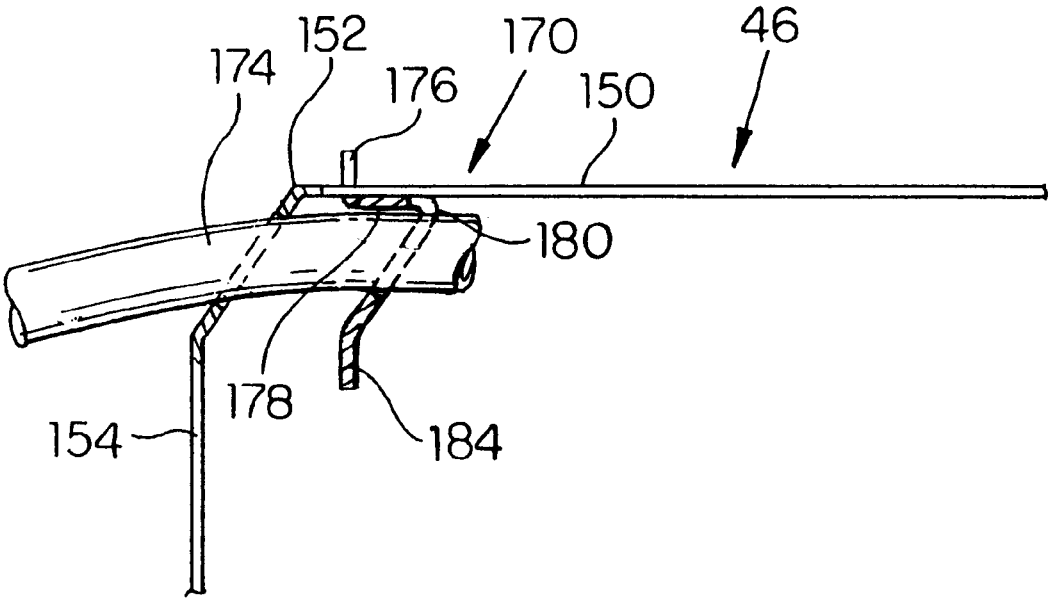
FIG. 13 is an enlarged side view of cable being inserted into a knock-out aperture and the clamping mechanism aperture of the junction box of FIG. 12.
Figure 14:
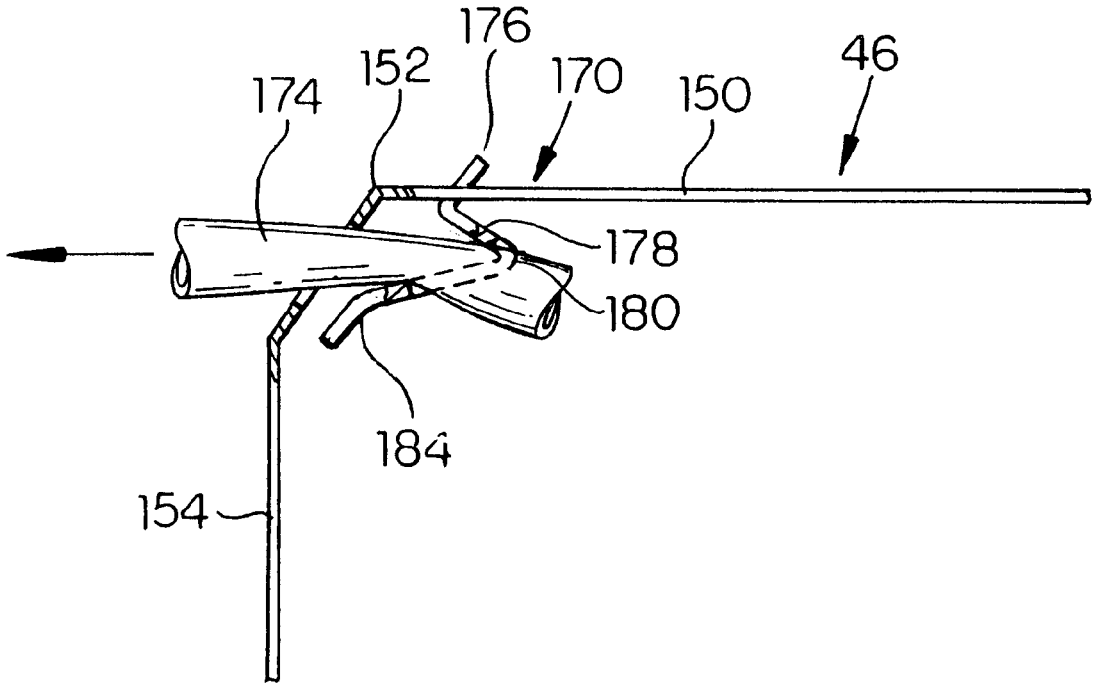
FIG. 14 is an enlarged side view of the clamping mechanism illustrating the position of the clamping mechanism body as force is applied to the cable from outside the junction box.

As shown in FIGS. 13 and 14, an important feature of one junction box useful with the recessed fixture frame 30 of the present invention is a clamping mechanism 170 comprising a body hingeably connected to at least one side wall 152, 154 of the junction box 46. The clamping mechanism 170 effectively prevents casual removal of electric cable from the junction box once the cable has been properly installed within the junction box.

As shown in FIGS. 13–16, the clamping mechanism 170, as used in one representative lighting application, comprises a body 171 including two tab members 204, 206. Each tab member 204, 206 has an aperture 172 formed therein for receiving electrical cable and a member 175 connecting the two tabs 204, 206. A pair of protrusions 200, 202 extend from the inner edge of each tab member toward the other tab member and a second pair of protrusions 201, 203 extend outwardly from the outer edge of each tab for connecting the body 171 to a complementary aperture formed in a wall of the junction box.

As shown in FIG. 13, the aperture 172 of the tab member is aligned with the aperture 168 in sidewall 152 such that the cable freely moves within the aperture during installation. As shown in FIG. 14, when the direction of movement of the cable is reversed, for example, when attempting to pull the cable straight out of the junction box, the body 171 pivots toward the sidewall 152 such that the edges of the aperture 172 clamp down or lock the cable 174, thus, preventing removal of the cable from the junction box 46 through the entry aperture 168.

Figure 15:
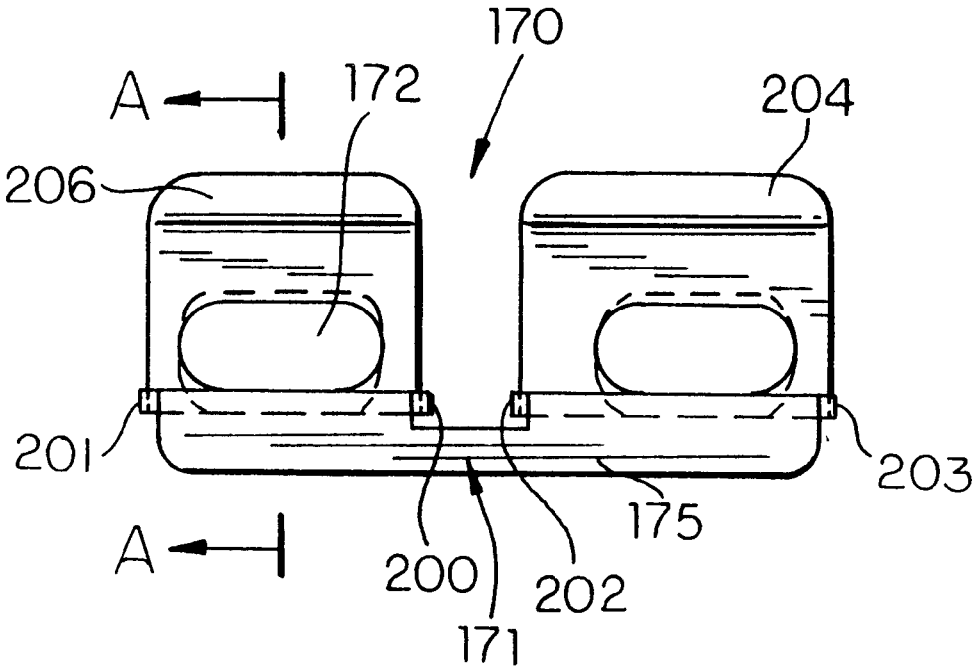
FIG. 15 is a plan view of the clamping mechanism body for a junction box useful with the present invention.
Figure 16:
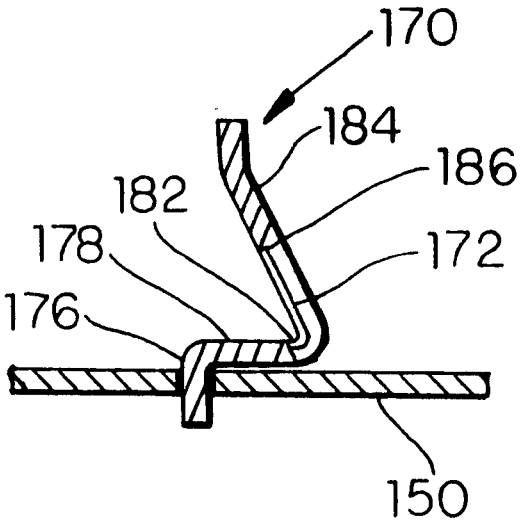
FIG. 16 is a cross-sectional view of the clamping mechanism body of FIG. 15 taken along line A—A.
Figure 17:
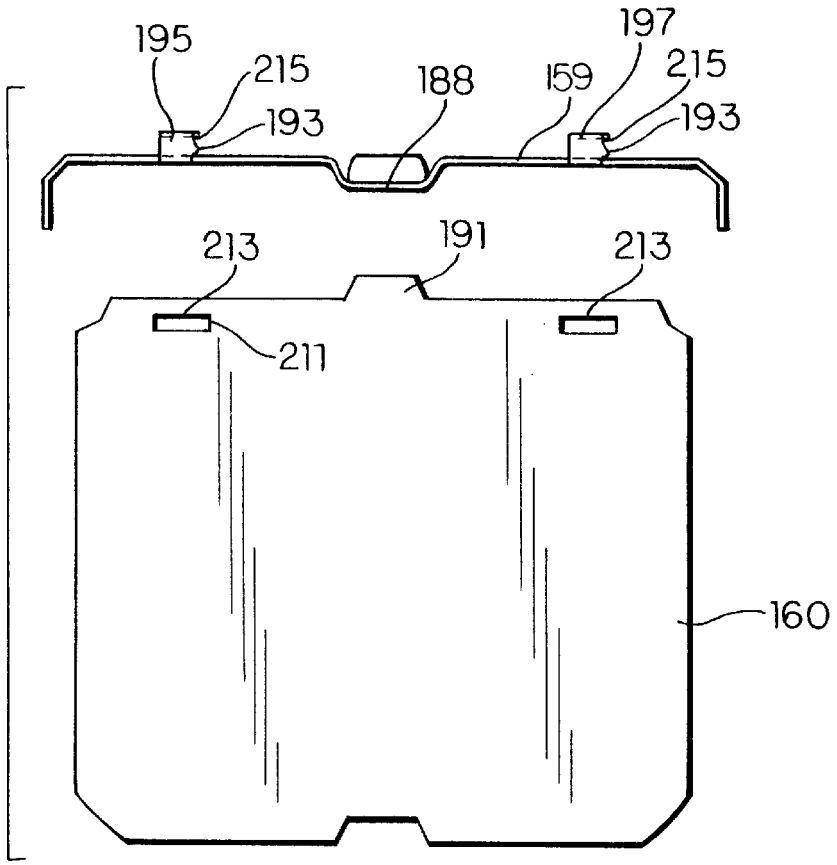
FIG. 17 is an partial exploded view illustrating the door and hinge of the junction box door of FIG. 11.
Figure 18:
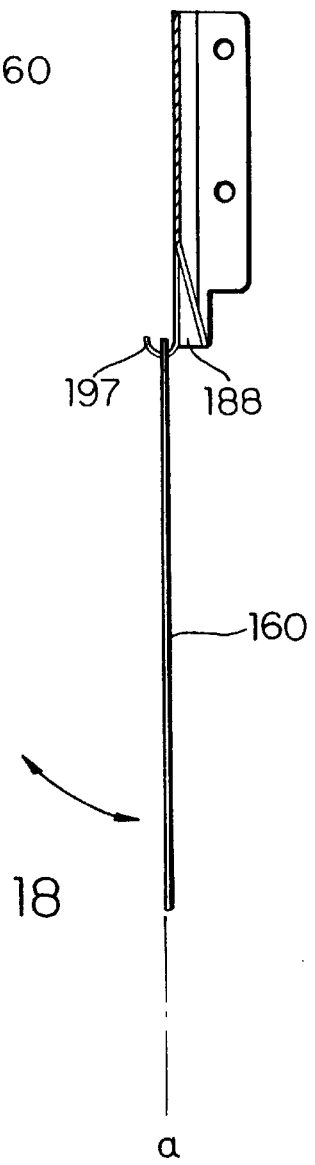
FIG. 18 is a side view of the junction box door in the open position.
Figure 19:
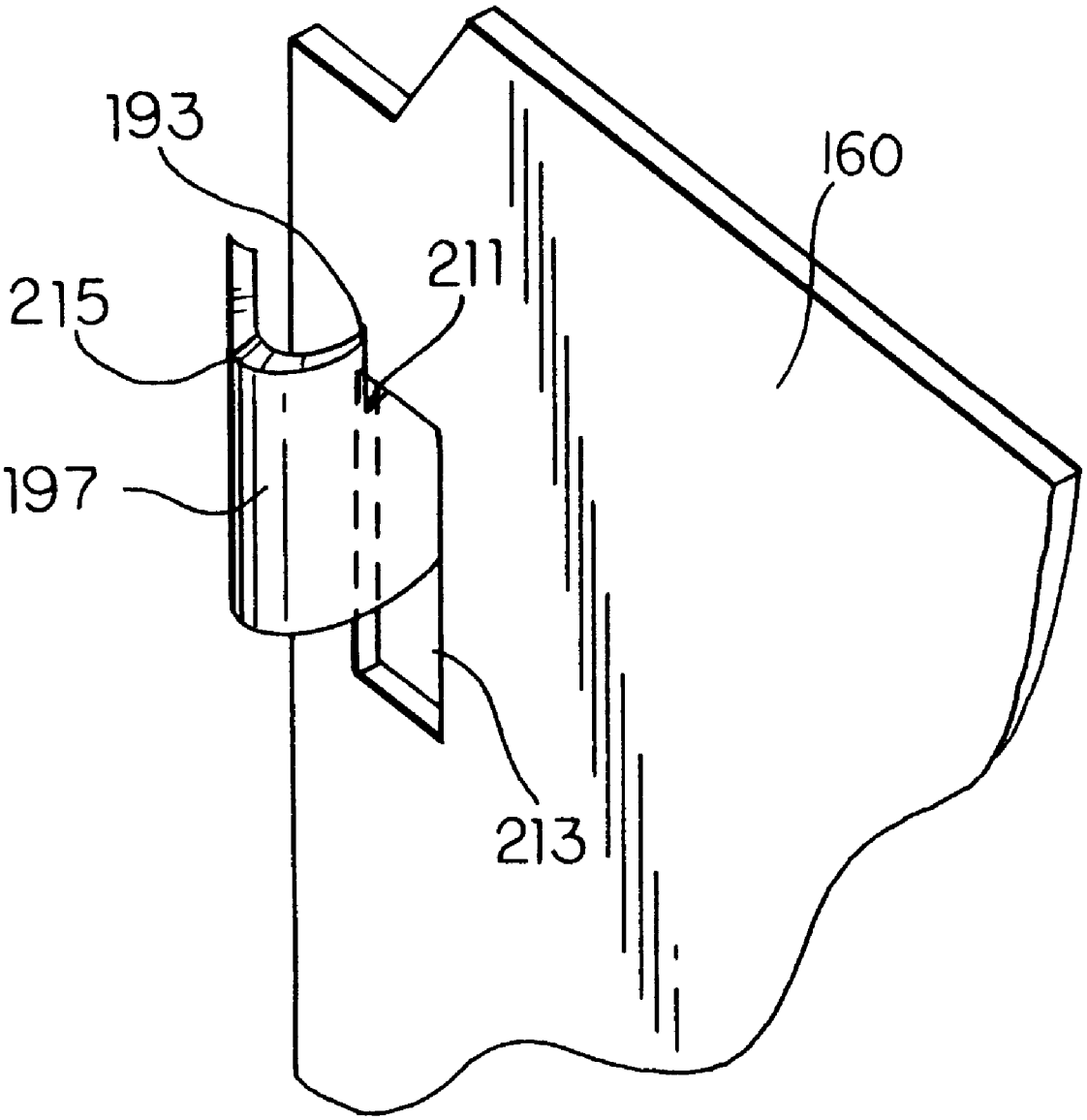
FIG. 19 is an exploded perspective view of the stop preventing the junction box door from closing during installation.

As shown in FIG. 16, the sectional view taken long line A—A of FIG. 15 illustrates the body 171, which is pivotably connected to the wall 150 of the junction box 46 and has a "Z" shaped profile. A first portion 176 of the body 171 is connected at about a ninety degree (90°) angle with a second portion 178. The second portion 178 of the body bends near a location 182 where the aperture 172 is formed in the body 171. The aperture 172 extends from the location 182 around the bend and along the third portion 184 of the "Z" shaped profile body 171 to a location 186.

The construction shown actually prevents removal (with the application of up to about fifty (50) pounds of force) of an electrical cable 174 once the cable is inserted through the aperture 172 in the body 171. The locking or clamping effect results from the body 171, being hingedly or rotatably connected to the wall 150 of the junction box 46 and the effect of the rotation of the body 171 on the cross-sectional area of the aperture 172 relative to the cable 174, as illustrated in FIGS. 13 and 14.

Specifically, when the second portion 178 of the body 171 is contiguous with the junction box wall 150, the cross-sectional area of the aperture 172 is maximized, allowing the cable to readily pass therethrough. When force is applied to the cable from a location outside the junction box, the second portion 178 rotates away from contact with the wall 150 and the third portion 184 rotates toward the knock-out aperture 168 through which the cable entered. In this position, the cross-sectional area of the aperture 172 is reduced resulting in the edges of the aperture 172 biting into the cable 174 thereby preventing the cable from being readily removed from the junction box 46.

The junction box 46 of the present invention could be used to wire-in applications, including but not limited to, fans, security systems, electric roof windows, lighting fixtures, or wall outlets, or other applications requiring strain relief when making electrical connections requiring, such as, for example, 12 or 14 gauge romex cable, non-metallic building wire, including applications requiring any number of electrical connections in any one junction box.

As shown in FIGS. 11 and 17–19, the access door or front wall 160 to the junction box is hinged for expediting access to the cable inside the junction box when the recessed fixture frame 30 is vertically suspended from one structural member (see FIG. 1). The unique feature of the illustrated hinged door 160 is that the door is designed to remain open by itself without support of a fastener. The hinge members 195, 197 formed in the bottom wall 159 of the junction box 46 in combination with aperture 213 of the door 160 and an extension 193 formed on each hinge member 195, 197 prevents gravity from swinging the door closed once propped open. In normal operation, to close the door 160 an installer just lifts the door slightly such that an edge 211 of each aperture 213 formed in the door 160 clears each extension 193 enabling the edge 211 of each aperture 213 to be positioned at 215, thus closing the door 160.

An important feature of the clamping mechanism 170 is the ability of the body 171 to be easily assembled to the junction box wall (snapped into) without requiring any fasteners to hold the body 171 in operative position in the junction box wall. The body 171 is designed to effectively snap into operative position and remain in operative position by just pushing the body 171 having protrusions 200, 201, 202 203, through slots that are proportioned, i.e. one is wider than the other, formed in the junction box wall. The wall slots and the protrusions 200, 201, 202, 203, operatively connected to the two tab members 204, 206, in combination, facilitate failsafe assembly at the manufacturing plant such that, once properly assembled, the clamping mechanism is not easily disassembled from the junction box wall.

The present invention represents a new style of recessed fixture frame mounting assemblies which incorporates standard fasteners for attaching to a variety of building constructions. The mounting assemblies have a conventional integral aligning feature and conventional length adjustment features but also include the hinged mounting stubs 50, 52 having an integrated, augur tipped screw which allows the recessed fixture to be installed into a wide variety of material, such as, for example, metal or wood. The augur tipped screw is especially valuable when connecting the recessed fixture frame to relatively thin wood in that the augur tipped screw effectively prevents the wood from splitting. Thus, when the conventional aligning feature is combined with a versatile augur tipped screw, the recessed fixture is readily installed into wood and/or metal by drilling.

Using an augur tipped screw rather than the conventional nail as the fastener, an installer has the advantage of readily and easily removing and repositioning the recessed fixture should the contractor, the under construction homeowner or occupant decide that the fixture should be moved to a different position. Such relocation is readily accomplished by merely removing the screws with a power driver and refastening the fixture in the new location. Such relocation is considerably easier than removing the nails used in the prior recessed fixture frames 30 and the augur tipped screw effectively prevents the wood from splitting.

The advantages of the present invention are best appreciated when considered in the context of a representative installation of the present invention. The first step in the installation is accomplished by locating and positioning the recessed fixture frame 30 along one joist 40 and lining up the bottom edge of the hinged mounting stub 50, 52 with the bottom of the joist. Next, first one and then the second hinged mounting stubs 50, 52 are connected to the joist.

Next, the installer opens the junction box door. After the knock-outs are opened, the cable is inserted into the junction box through the aperture located in the clamping mechanism corresponding to the particular knock-out. The wiring connections are then made inside the junction box. During this step, care must be taken to insure that the wiring and the connections inside the junction box do not interfere with the clamping mechanism 170 action for providing strain relief.

Once the junction box is wired, the recessed fixture frame 30 is rotated about ninety degrees (90°) such that the opposite ends of the mounting assemblies having non-hinged extensions 51, 53 (see FIGS. 2 and 13) are operatively positioned proximal the opposite joist 42. The non-hinged extensions 51, 53 are fastened in place in a manner similar to the hinged mounting stubs 50, 52.

Next, the installer adjusts the position of the lighting housing 32 vertically and horizontally to the desired position along the mounting assemblies 36, 38 and locks that position in place.

When installing lighting fixtures, the reflector or trim 106 is connected to the socket using spring tabs which engage into slots in the reflector by inserting over the small opening until the spring tabs of the socket are fully engaged into corresponding slots in the reflector.

One specific feature of the present invention is the ease of removing the trim. As specifically shown in FIG. 4, in order to remove the trim from the recessed lighting fixture frame, the installer would place his or her fingers on the reflector spring 98 from inside the trim 106 until the trim disengages from the reflector spring which is operatively connected to the socket. At this point the trim, if installed in a ceiling, would merely fall into the installer's hand. If it were desirable to remove the socket cup 98, the installer would then pull on one of the socket spring legs 120, 122 thereby disengaging the socket housing 100 from the housing 32 and allowing the socket housing 100 to be removed from the housing 32.

While the present invention has been described as a lighting product, it should be obvious to those skilled in the art that there are many other possible applications therefore, including, but not limited to, recessed devices, such as, for example, exhaust fans, smoke detectors, security systems or other devices that are wired, roughed-in. Rough-in is the term used when just the bare wood structure or metal structure is showing and there is no sheeting or covering over the structure and the recessed fixture is accessible from below for wiring-in.

Changes and modifications in the specifically described embodiments can be carried out without departing from the scope of the invention which is intended to be limited only by the scope of the appended claims.

What is claimed is:

1. A recessed fixture frame for supporting an enclosure in a recessed space, said fixture comprising:

a frame band supporting said enclosure;

at least one mounting assembly operatively secured to said frame band, said mounting assembly including means for selectively increasing or decreasing its length; and means operatively hingeably connected to at least one end of said at least one mounting assembly for hingedly securing said mounting assembly to a structural member, said securing means being pivotable between a first unlocked position, in which the enclosure is below the recess, to a second locked position in which the enclosure is within the recess.

2. The recessed fixture frame of claim 1 further comprising:

an enclosure for housing an electric fixture, the enclosure having slots for vertically adjusting the housing relative to the frame band.

3. The recessed fixture frame of claim 1 further comprising:

a junction box having a plurality of sides operatively connected to the frame band for operatively electrically connecting the electric fixture to an electrical system; and clamping means, operatively positioned in at least one side of the junction box, for restricting movement of an electric cable out of the junction box once the cable is installed in the junction box, the clamping means including at least one aperture sized such that the cable freely moves within the aperture as the cable is inserted into the clamping means aperture, when the direction of movement of the cable is reversed, the clamping means aperture clamps the cable such that removal of the cable from the junction box is effectively prevented.

4. The recessed fixture frame of claim 1 wherein the at least one mounting assembly connecting means comprises:

at least one mounting stub operatively hingeably connected to at least one end of the at least one mounting assembly, the stub including means for preventing rotation of the mounting assembly beyond about ninety (90°) degrees with respect to the mounting stub.

5. A recessed fixture frame comprising:

a frame band;

at least one mounting assembly operatively connected to the frame band, the mounting assembly including a channel member and a bar member, the bar member being movable relative to the channel member for selectively increasing or decreasing the length of the mounting assembly; and at least one mounting stub, operatively hingeably connected to at least one end of the mounting assembly, the mounting stub having a hook for cooperating with a complementary member formed in the bar member, for locking the mounting stub and the bar member such that the bar member is prevented from moving relative to the channel member.

6. A recessed fixture frame comprising:

a frame band;

at least one mounting assembly operatively connected to the frame band, said mounting assembly including means for selectively increasing or decreasing its length;

at least one mounting stub operatively hingeably connected to at least one end of said at least one mounting assembly;

an enclosure for housing an electric fixture, said enclosure having means for vertically adjusting said enclosure relative to said frame band, said enclosure having an open end and a closed end, said open end having a hemmed edge, said closed end having a self-adjusting spring means for securing a socket and a trim therein and including means for receiving at least one electric cable;

a junction box operatively connected to said frame band at a predetermined distance from said enclosure, said junction box including at least five side walls, a top wall and a bottom wall, at least one of said side walls having an opening for receiving said at least one electric cable, said junction box including means for securing said top wall and said bottom wall of said junction box to said side walls; and clamping means operably positioned in at least one of said side walls of said junction box for restricting movement of said at least one electric cable, said clamping means including at least one aperture having about the same cross-sectional size as the cross section of said at least one electrical cable, said clamping means being positioned such that said at least one cable is able to freely move within said clamping means aperture as said at least one cable is inserted into said aperture, said clamping means aperture engaging said at least one the cable when the direction of movement of said at least one cable is reversed such that removal of said at least one cable from said junction box is effectively prevented.

7. A device for connecting a recessed fixture frame to a structure, the device comprising:

a mounting assembly, the mounting assembly including means for selectively increasing or decreasing its length;

a fastening member comprising:

a first portion and a second portion, the first portion being connected to the second portion at about a ninety degrees (90°) angle; and the fastener member being operatively hingeably connected to the mounting assembly, the fastener member further including a locking means for locking the second portion to the mounting assembly in a first position, the first position being at about ninety degrees (90°) relative the mounting assembly, the second portion disengaging from the mounting assembly when the mounting assembly is rotated about forty five degrees (45°) from the first position; and means, operatively positioned in the first portion, for connecting the device to a support structure.

8. A quick connect/release mechanism for connecting/releasing trim to/from a light socket, the mechanism comprising:

a light socket housing;

a light socket operatively positioned inside the socket housing;

a trim positioned about said socket housing and having at least two notches formed therein; and trim retaining means including a spring secured to said socket and engaging the inner wall of said socket housing, said spring including offset ends for mating with said at least two notches formed in said trim such that said trim is effectively retained in position relative to said socket housing and is readily removable from operative connection to the socket.

9. The mechanism of claim 8, wherein said spring comprises:

a "C" shaped resilient member having a pair of protrusions operatively formed on each of said offset ends for cooperating with said at least two notches formed in said trim, for retaining said trim in operative position relative to said socket.

10. The mechanism of claim 9 wherein the inwardly offset ends enable an installer to apply pressure inwardly away from the outer surfaces of the socket housing in order to operatively connect the trim to the socket housing.

11. The mechanism of claim 10 wherein, once the trim is properly positioned on the light socket, the trim is quickly released therefrom by grasping the inwardly offset ends and applying inward pressure toward the socket such that the protrusions disengage from the slots thereby disengaging the trim from the socket.

12. The mechanism of claim 11 wherein, when the socket is positioned in a ceiling, when disengaged, the trim will fall by force of gravity into the hand of an installer.

13. A method of installing a recessed fixture frame having a junction box between two structural members, the junction box including a door and a clamping mechanism, the method comprising the steps of:

positioning a recessed fixture frame having two mounting assemblies and a hinged mounting stub operatively connected to at least one end of each assembly relative the two structural members;

lining up the bottom edge of the hinged mounting stubs with the bottom of the first structural member;

connecting the first mounting stub to the first structural member;

connecting the second mounting stub to the second structural member;

opening the junction box, the junction box including knock-outs;

opening the appropriate number of knock-outs;

inserting non-metallic cable through an aperture resulting from the opening of each knock-out;

inserting the cable through an aperture formed in each clamping mechanism corresponding to the particular aperture formed by opening each knock-out;

connecting the cable inside the junction box;

closing the junction box door;

rotating the recessed fixture frame upwardly about ninety degrees (90°) such that the opposite ends of the mounting assemblies having non-hinged mounting stubs are operatively positioned relative to the second structural member; and connecting the non-hinged mounting stubs to the second structural member.

14. The method of claim 13 further comprising the step of:

positioning the housing between the mounting assemblies.

15. The method of claim 14 further comprising the step of:

positioning plasterboard or other type ceiling contiguous with the structural members after the housing has been positioned.

16. The method of claim 15 further comprising the step of:

adjusting the housing flush with the surface of the plasterboard.

17. The method of claim 16 further comprising the step of:

when installing lighting fixtures, connecting a trim to a socket using spring tabs which engage into slots in the trim.

18. The method of claim 17 wherein the light fixture installing step further comprises:

inserting the portion of the socket having the spring tabs inside of the trim; and adjusting the position of the trim over the edge of the socket until the spring tabs are fully engaged into corresponding slots in the trim.

19. The method of claim 18 further comprising the step of:

inserting the trim into the housing by pushing straight up into the housing until the trim is tight against the ceiling.

20. A method of removing lighting trim and the associated socket from a recessed light fixture, the method comprising the steps of:

grasping a reflector spring by the ends thereof from inside the trim;

squeezing the spring ends toward each other until the trim disengages from said reflector spring; removing the trim from the lighting housing, removing the socket by pulling on one of said reflection spring ends, thereby disengaging the socket from the housing.

21. A telescoping mounting assembly for use in mounting a lighting fixture to a structural member, said mounting assembly comprising:

a channel member;

a bar member, said channel member and said bar member cooperating to selectively lengthen or shorten the mounting assembly;

a mounting stub hingeably connected to at least one end of said channel member, and means for selectively locking said mounting stub relative to said bar member.

22. The mounting assembly of claim 21 wherein the stub is connected to the channel member by a fastener.

23. The mounting assembly of claim 21 wherein the locking means further comprises:

a mating member operatively connected to the hinged mounting stub; and a complementary portion, operatively positioned in the bar member, for mating with the mating member.

24. The mounting assembly of claim 23 wherein, when the bar member having the complementary portion therein is positioned such that the mating member is mated therewith, the bar member is prevented from moving relative the channel member and the relative position of the mounting stub to the mounting assembly is at about a ninety (90°) degree angle.

25. The mounting assembly of claim 24 wherein, without the mating member being engaged with the complementary portion, the bar member could unrestrainably move relative the channel member.

26. A fixture for use in installing a unit within a recess having spaced structural members, said fixture comprising a holding member for carrying the unit, mounting means operatively secured to said holding member and including means for varying its length so as to permit said mounting means to be extended between the structural members, and means operatively and movably secured to said mounting means for fastening said mounting means to the structural members, said fastening means being movable between a first position, in which the length of said mounting means can be varied, to a second position in which the length of said mounting means cannot be varied.

27. The fixture of claim 26, in which said fastening means includes a stub hingedly affixed to each end of said mounting means.

28. The fixture of claim 27, in which said mounting means and said fastening means include cooperative means effective when engaged to place said fastening means in its said second, locked position.

29. The fixture of claim 28, in which said cooperating means includes a tongue secured to one of said mounting means and said fastening means, and a groove in the other of said mounting means and said fastening means for releasably receiving said tongue when said fastening means is in its said second, locked position.

30. The fixture of claim 29, in which said first position of said fastening means is substantially 90° displaced from its said second position.

31. The fixture of claim 30, in which said mounting means includes a longitudinal channel member and a longitudinal bar slidably received within said channel member for relative longitudinal movement therealong.

32. The fixture of claim 31, in which said tongue engages and locks said slidable bar within said channel member when said fastening means is in its said second, locked position.

33. The fixture of claim 26, in which said mounting means and said fastening means include cooperative means effective when engaged to place said fastening means in its said second, locked position.

34. The fixture of claim 28, in which said cooperating means includes a tongue secured to one of said mounting means and said fastening means, and a groove in the other of said mounting means and said fastening means for releasably receiving said tongue when said fastening means is in its said second, locked position.

35. The fixture of claim 34, in which said mounting means includes first and second spaced, substantially parallel channel members, said holding member including a frame band extending between said mounting means.

36. The fixture of claim 35, in which said frame band includes first and second slots adjacent its opposite ends, said channel members respectively passing through said slots.

37. The fixture of claim 27, in which said first position of said fastening means is substantially 90° displaced from its said second position.

38. The fixture of claim 37, in which said mounting means includes a longitudinal channel member and a longitudinal bar slidably received within said channel member for relative longitudinal movement therealong.

39. The fixture of claim 38, in which said cooperating means prevents relative movement of said channel member and said bar when said fastening means is in its said second locked position.

40. The fixture of claim 39, in which said cooperating means includes a tongue secured to one of said mounting means and said fastening means, and a groove in the other of said mounting means and said fastening means for releasably receiving said tongue when said fastening means is in its said second locked position.

41. The fixture of claim 40, in which said tongue engages and locks said slidable bar within said channel member when said fastening means is in its said second locked position.

42. The fixture of claim 26, in which said mounting means includes first and second spaced substantially parallel channel members, said holding member including a frame band extending between said mounting means.

43. The fixture of claim 42, in which said frame band includes first and second slots adjacent its opposite ends, said channel members respectively passing through said slots.

* * * * *